US006459412B1

(12) United States Patent
Koyanagi et al.

(10) Patent No.: US 6,459,412 B1
(45) Date of Patent: Oct. 1, 2002

(54) ANTENNA UNIT

(75) Inventors: Yoshio Koyanagi; Hisashi Morishita; Kyohei Fujimoto, all of Kanagawa (JP)

(73) Assignee: Matsushita Electric Industrial Co., Ltd., Osaka (JP)

( * ) Notice: Subject to any disclaimer, the term of this patent is extended or adjusted under 35 U.S.C. 154(b) by 0 days.

(21) Appl. No.: 09/716,791

(22) Filed: Nov. 20, 2000

(30) Foreign Application Priority Data

Nov. 29, 1999 (JP) ..... 11-337757

(51) Int. Cl.[7] ..... H01Q 1/24; H01Q 1/36
(52) U.S. Cl. ..... 343/702; 343/859; 343/895
(58) Field of Search ..... 343/702, 895, 343/859, 850

(56) References Cited

U.S. PATENT DOCUMENTS

| | | | | |
|---|---|---|---|---|
| 5,006,861 A | | 4/1991 | Miller et al. | 343/895 |
| 5,929,825 A | | 7/1999 | Niu et al. | 343/895 |
| 6,204,817 B1 | * | 3/2001 | Edvardsson | 343/702 |
| 6,271,796 B1 | * | 8/2001 | Itoh et al. | 343/702 |

FOREIGN PATENT DOCUMENTS

JP 8-316725 11/1996

OTHER PUBLICATIONS

WO 00/03452, Printed Twin Spiral Dual Band Antenna, 1/2000.

Patent Abstract of Japan, JP5183325, Antenna for Mobile Radio Equipment, 7/1993.

* cited by examiner

*Primary Examiner*—Don Wong
*Assistant Examiner*—Hoang Nguyen
(74) *Attorney, Agent, or Firm*—Pearne & Gordon LLP

(57) ABSTRACT

In an antenna unit adapted to be incorporated inside a main body of a mobile radio set, there are provided a pair of helical antenna elements (102), (103) connected to a balanced feeding line (104), the helical antenna elements having antenna axes in a direction parallel to a base plate (201) of the radio set, and being arranged in proximity to the base plate of the radio set at a sufficiently small distance as compared with their wavelength. By conducting a balanced power supply to the helical antenna elements, an electric current component flowing on the base plate of the radio set can be reduced, thus decreasing influence of the human body when the radio set is carried by the human hand. Additionally, the antenna can posses radiation characteristics of both the electric current type antenna and the magnetic current type antenna, and therefore, the receiving performance when the radio set is tiltedly used will be enhanced.

5 Claims, 4 Drawing Sheets

ANTENNA UNIT

BACKGROUND OF THE INVENTION

The present invention relates to an antenna unit which is mainly used in a small mobile radio set, and more particularly to such an antenna unit that good radiation characteristic can be obtained even when it is used in proximity to a human body.

Recently, a demand for mobile radio sets such as mobile telephones has been sharply growing, and a compact, lightweight and thin radio set has been sought for.

As a conventional antenna for a mobile telephone, a fixed type helical antenna, a planner inverted F antenna, etc. have been popular, and an antenna system of a small size which has good portability and will not cause an inconvenience when it is used with a compact radio set has been realized.

FIG. 5 is a view of an outer appearance of the fixed type helical antenna which has been widely used as the conventional antenna for the mobile telephone. The fixed type helical antenna element 10 is provided on a main body 11 of a mobile telephone set to realize a compact and lightweight antenna system.

However, the fixed type helical antenna as shown in FIG. 5 is so constructed as to protrude from the main body of the radio set in order to obtain desired characteristics. Therefore, it has been a problem that a protruded portion of the antenna will be an obstacle in case where the radio set is carried in a bag or in a pocket, and the antenna tends to be broken when the radio set has fallen. For this reason, in Japanese Publication No. Hei. 8-316725 of unexamined Patent Application, there is proposed a helical antenna which can be incorporated in the main body of the mobile telephone set as shown in FIG. 6. This antenna 90 comprises a helical antenna element 94 and an inductor 91 integrally formed therewith. By incorporating the antenna in the main body of the mobile telephone set, such a design of the mobile telephone set that the antenna element will not protrude from the main body of the mobile telephone set can be realized.

The helical antenna as shown in FIG. 5 or 6 can be generally considered as the antenna which is composed of a loop antenna and a dipole antenna connected in series. The loop antenna is a magnetic current type antenna equivalent to a magnetic current element which is placed at a loop center of a loop face perpendicularly to the loop face, while the dipole antenna is an electric current type antenna. The helical antenna is considered to be equivalent to those antennas combined.

However, since both the fixed type helical antenna in FIG. 5 and the incorporated type helical antenna in FIG. 6 are supplied with electric power through a feeding line of an unbalanced system such as a coaxial line, a large amount of earthed electric current flows not only on the antenna element but also on a base plate of the radio set, and as the result, the antenna usually functions as the electric current type antenna. Therefore, when the radio set is used in proximity to the human body, the antenna will be influenced by the human hands or head resulting in a serious deterioration of gain.

FIG. 7 is a characteristic diagram representing radiation directivity of the conventional fixed type helical antenna. There has been a drawback that as a result of a large amount of the electric current which has flowed not only on the antenna but also on the base plate of the radio set, a θ-component, that is, an electric current component is dominant, and the antenna will hardly function as the magnetic current type antenna. As the result, there has been such an inconvenience that in a state where the radio set is carried by the human hand and tiltedly used, polarization of an incoming wave from a base station and polarization of the antenna on the radio set will not match, and accordingly, receiving performance will be seriously deteriorated.

SUMMARY OF THE INVENTION

The invention has been made to solve the above described problems in the conventional art, and its object is to provide a compact and high-gain antenna unit which can efficiently receive the incoming wave even though the radio set is used tiltedly.

Therefore, according to the invention, in an antenna nit adapted to be incorporated in a main body of a mobile radio set, there are provided a pair of helical antenna elements connected to a balanced feeding line, the helical antenna elements having antenna axes in a direction parallel to a base plate of the radio set and being arranged in proximity to the base plate of the radio set at a sufficiently small distance as compared with their wavelength.

As the result, by conducting a balanced power supply to the helical antenna elements, an electric current component flowing on the base plate of the radio set can be reduced, thus decreasing the influence of the human body when the radio set is carried by the human hand.

Additionally, the antenna can possess both radiation characteristics of the electric current type antenna and the magnetic current type antenna, and therefore, the receiving performance when the radio set is tiltedly used will be enhanced.

Further, a compact and thin antenna system can be realized.

DETAILED DESCRIPTION OF THE PREFERRED EMBODIMENT

First Embodiment

Figure 1:
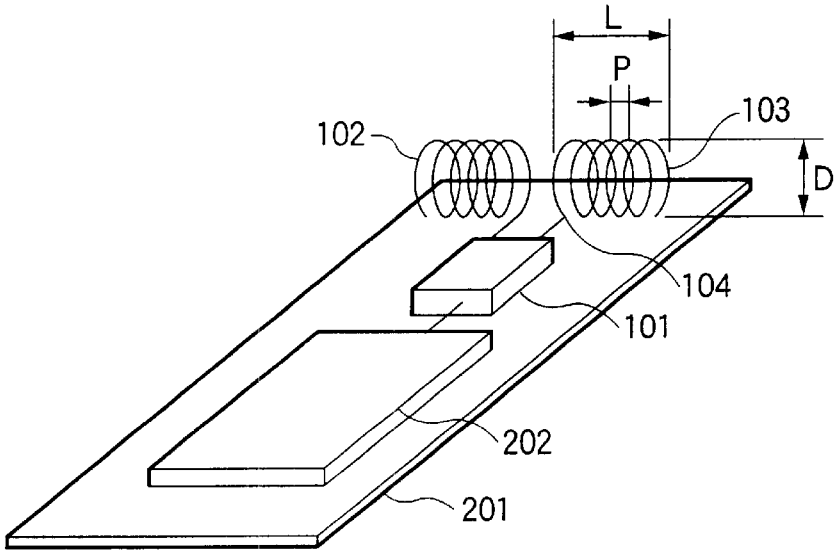
FIG. 1 is a structural view of an antenna unit of a first embodiment according to the invention.

An antenna unit of a first embodiment according to the invention includes a pair of helical antenna elements 102, 103 as shown in FIG. 1. These helical antenna elements 102, 103 are connected to a radio circuit 202 provided on a base plate 201 of the radio set by way of a balun 101. Connection between the balun 101 and the helical antenna elements 102, 103 is conducted by a balanced feeding line 104. The balun

101 is provided in order to interconnect a feeding line of an unbalanced system and the feeding line 104 of the balanced system, in case where the radio circuit 202 is connected to the feeding line of the unbalanced system. In case where an output of the radio circuit 202 is composed of the balanced system from the beginning, the helical antenna elements 102, 103 can be directly connected to the radio circuit 202 by means of the feeding line 104 without the interconnection by the balun 101.

The first helical antenna element 102 and the second helical antenna element 103 in the pair are wound in a same direction, and provided on the base plate 201 of the radio set at a sufficiently small distance as compared with their wavelength, setting their antenna axes in parallel to the base plate 201 of the radio set.

This antenna set is incorporated in the radio set for use.

By conducting the balanced power supply to a pair of the helical antenna elements 102, 103, the earthed electric current flowing through the base plate 201 of the radio set can be reduced. Moreover, by providing the antenna in proximity to the base plate 201 of the radio set, it will be possible to adjust the radiation directivity and the polarization utilizing an image formed on a ground face. Still further, by providing the antenna in proximity to the base plate 201 of the radio set, the radio set can be formed in a thin shape, and the antenna can be actually mounted on a printed substrate of the radio set.

Figure 2:
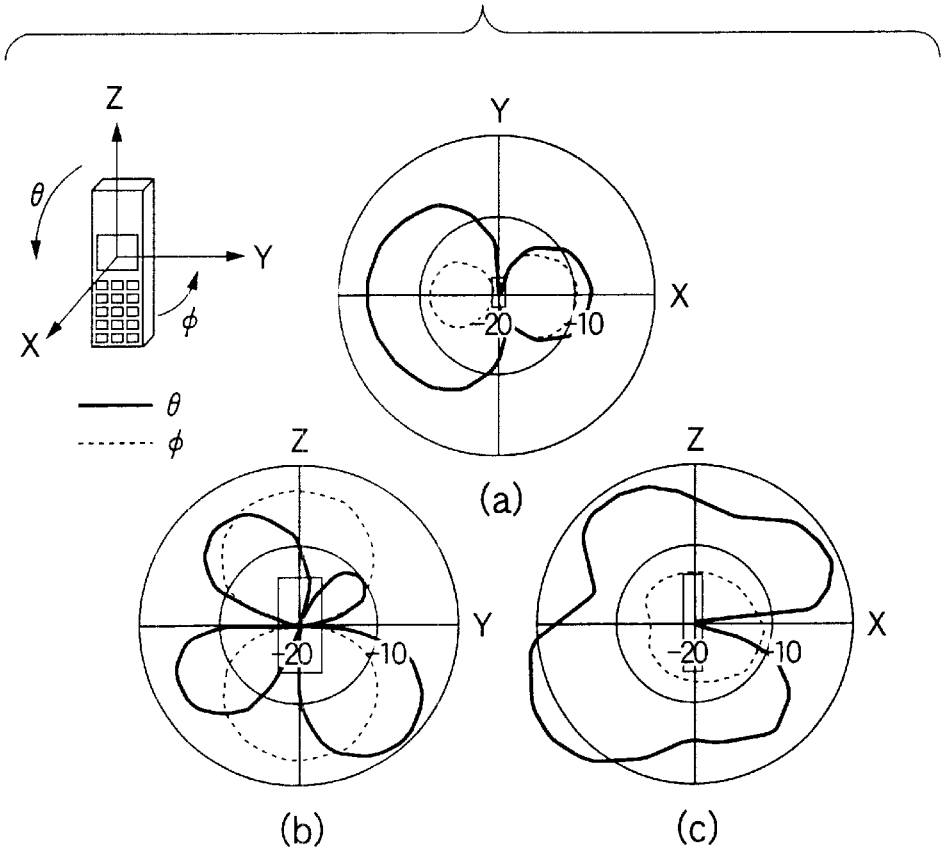
FIG. 2 is a characteristic diagram representing radiation directivity in the antenna unit of the first embodiment.

FIG. 2 is a characteristic diagram representing the radio directivity of the antenna unit of the first embodiment. This helical element has a diameter $D=0.042\lambda$, a pitch $P=0.0105\lambda$, and a total length $L=0.056\lambda$, and employs a copper wire of $0.005\lambda$ as linear material. The helical elements are fixed on a copper plate of $0.74\lambda$* $0.225\lambda$ in parallel to the copper plate. A distance between the copper plate and a center of the helical element is $0.051\lambda$.

In radiation directivity patterns in FIGS. 2(*a*), (*b*) and (*c*), a solid line represents a θ-component (Eθ) of an electric field and a dotted line represents a ϕ-component (Eϕ) of the electric field. As apparent from FIGS. 2(*a*) and (*c*), he θ-component of the electric field is radiated in a direction of −X in a co-ordinate as shown in FIG. 2. This represents a directivity pattern in which an electromagnetic wave is radiated in an opposite direction to the human body during radio communication. As the result, absorption of the electromagnetic wave by the human body can be decreased.

Figure 7:
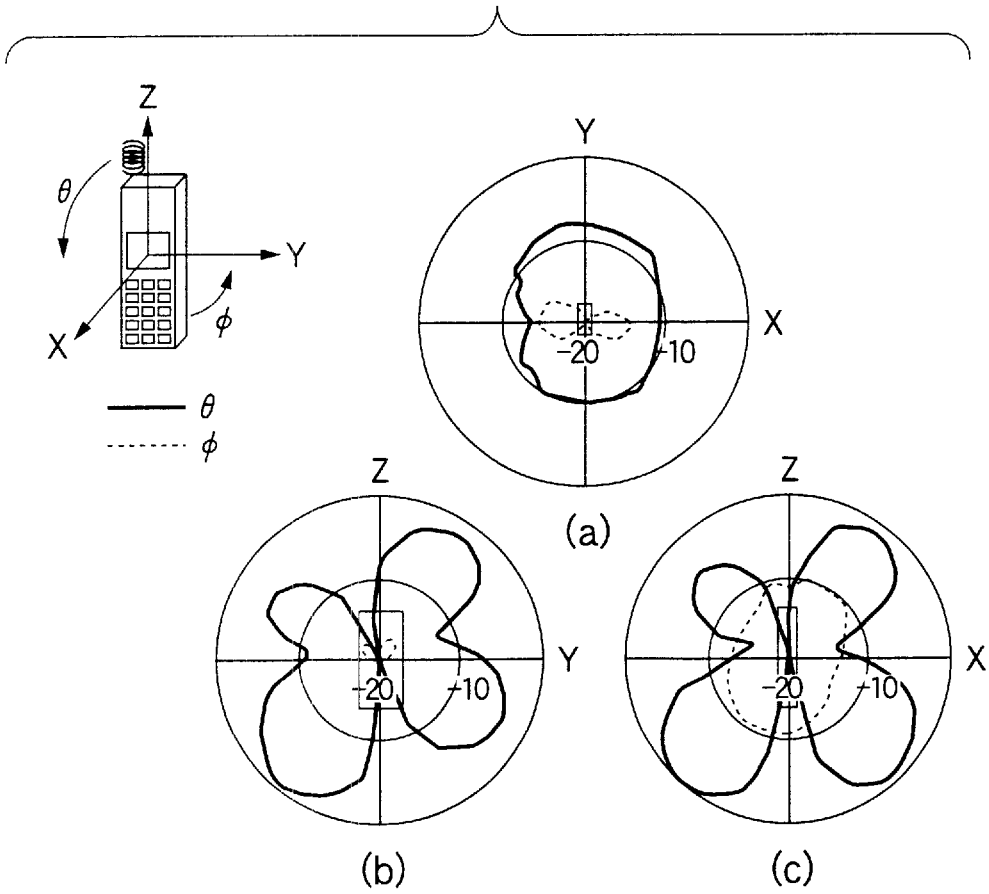
FIG. 7 is a characteristic diagram representing radiation directivity in the conventional fixed type helical antenna.

On the other hand, in the characteristic diagram of the radiation directivity of the conventional helical antenna as shown in FIG. 7, the θ-component is dominant in either directions and the radiation directivity will not match the polarization of the base station when the radio set is tilted. In contrast, the ϕ-component is relatively large in FIG. 2(*b*), and this ϕ-component becomes almost equal to a vertical polarization during the communication period when the radio set is tilted by 60 degree on a Y-Z plane, and accordingly, it becomes easier to receive the vertical polarization which is a main polarization of the incoming wave from the base station. For this reason, the receiving performance in actual radio wave environment will be enhanced.

Because this antenna unit has a behavior having both characteristics of the magnetic current type antenna and the electric current type antenna combined, both the θ-component and the ϕ-component are generated in the electric field. In FIGS. 2(*a*) and (*c*), the E-component represents the radiation by the magnetic current type antenna, and in FIG. 2(*b*), the ϕ-component represents the radiation by the electric current type antenna.

A ratio between the components of the magnetic current type antenna and the electric current type antenna can be adjusted by changing parameters of the diameter D, the pitch P, and the total length L of the helical elements and the distance from the copper plate. The antenna unit which can act as either of the magnetic current type antenna and the electric current type antenna has been realized with the structure of this embodiment.

Figure 3:
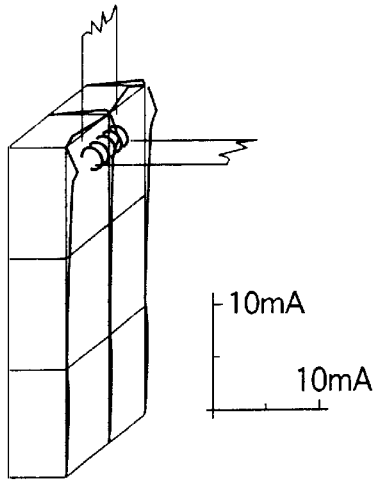
FIG. 3 is a diagram of electric current distribution in the antenna unit of the first embodiment.

FIG. 3 is a diagram showing an electric current distribution of the antenna unit according to the first embodiment. In FIG. 3, the base plate of the radio set and the antenna elements are approximated by wires, and distribution of absolute values of the electric current flowing through the wires when the antenna is supplied with power is represented in three dimensions.

Since the helical antenna elements 102, 103 are fed by a balanced feeding line, it is found that the electric current on the helical antenna elements is dominant and a large amount of the electric current does not flow on the base plate of the radio set. However, as the electric current flows more or less on the base plate of the radio set near the antenna elements, a combined pattern of the radiation directivities of this electric current and the electric current on the antenna elements is obtained as shown in FIG. 2.

Figure 8:
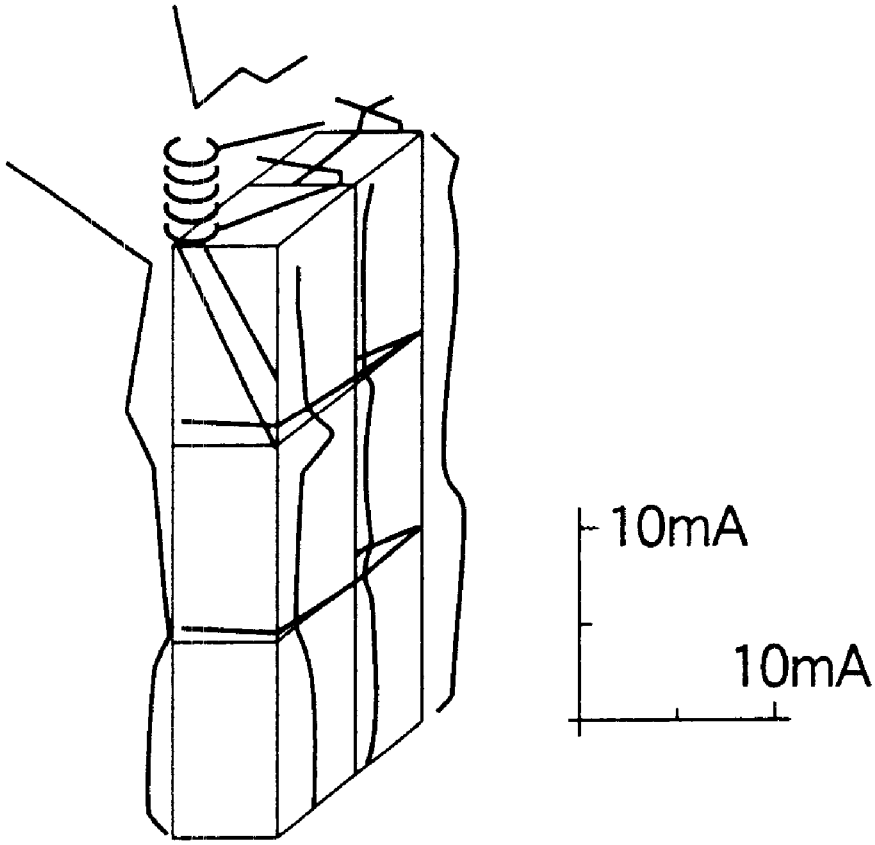
FIG. 8 is a diagram of electric current distribution of the conventional fixed type helical antenna.

As compared with the electric current distribution of the conventional fixed type helical antenna which is shown in FIG. 8, a behavior of this electric current distribution is found to be such that very little electric current flows on the base plate of the radio set, and the influence of the human body when the radio set is carried by the hand is very small. In case where a large amount of the electric current flows on the base plate of the radio set as shown in FIG. 8, the base plate also behaves as a part of the antenna, and when the radio set is carried by the human hand, the electric current distribution largely varies, incurring a change of antenna impedance and a decrease of the radiation efficiency. However, such influences of the human body can be decreased by thus reducing the electric current on the base plate of the radio set as shown in FIG. 3.

As describe above, with this antenna unit of he incorporated type, the antenna of the balanced system has been realized by employing a pair of the helical antenna elements. Accordingly, a very small amount of the electric current component flows on the base plate of the radio set and a drop of the gain will be small, even when the radio set is used in proximity to the human body.

Because a very small amount of the electric current component flows on the base plate of the radio set, the antenna unit can possess both characteristics of the electric current type antenna and the magnetic current type antenna even though a pair of the helical antenna elements are arranged near the base plate of the radio set. Thus, the incoming wave can be efficiently received even though the radio set is used in a tilted manner.

Further, because the helical antenna elements are arranged near the base plate of the radio set, the image formed on the base plate of the radio set can be utilized for adjustment of the radiation directivity and the polarization. The directivity pattern will be such that the electromagnetic wave is radiated in the opposite direction to the human body during the radio communication, thus further decreasing the influence of the human body. Moreover, the directivity pattern will be such that the main polarization of the incoming wave from the base station is easily received in the tilted state of the radio set, and the receiving performance when the radio set is tilted can be further improved.

Second Embodiment

In the antenna unit of the second embodiment, the ratio between the components of the electric current type antenna and the magnetic current type antenna can be varied.

Figure 4:
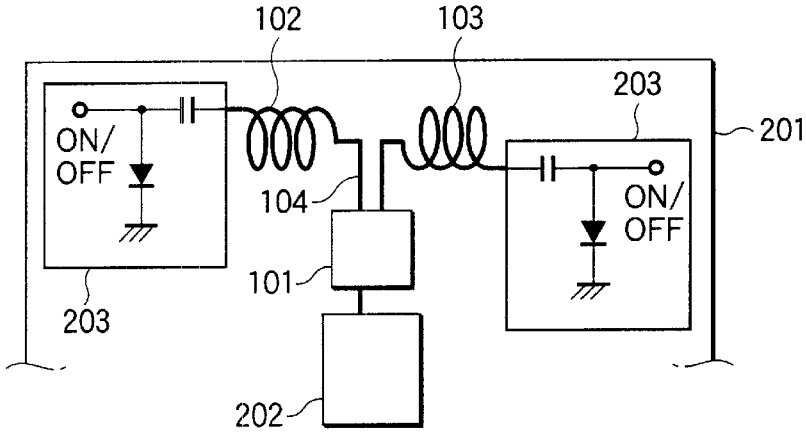
FIG. 4 is a structural view of an antenna unit of a second embodiment according to the invention.
Figure 5:
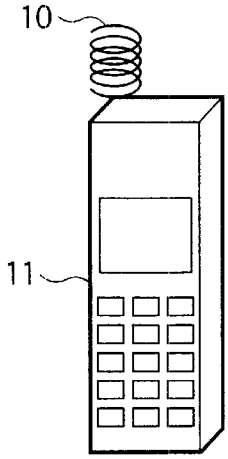
FIG. 5 is a perspective view of a radio set which is provided with a conventional fixed type helical antenna.
Figure 6:
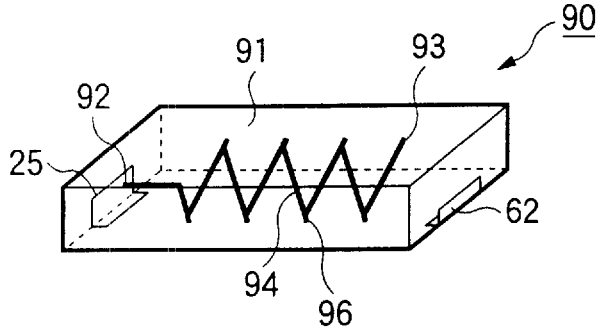
FIG. 6 is a structural view of a conventional incorporated type antenna.

This antenna unit has regulating circuits 203 connected to respective tip ends of the first helical antenna element 102 and the second helical antenna element 103, as shown in FIG. 4, for regulating the ratio between the component of the magnetic current type antenna and the component of the electric current type antenna. With respect to other parts of the structure, this embodiment is substantially the same as the first embodiment.

Each of these regulating circuits 203 includes a diode for conducting an on-off operation of capacity loaded on the helical antenna elements 102, 103 and capacity loading. he electric current distributions on the helical antenna elements and the base plate of the radio set can be varied by the capacity loaded on the tip ends of the helical antenna elements. In an unloaded state, the antenna unit in this embodiment behaves in a similar manner to the antenna unit in the first embodiment, but in a state where the capacity is loaded, effective electric length of the helical antenna elements will be longer and the electric current distributions on the helical antenna elements and the base plate of the radio set will change, thereby to vary the ratio between the components of the electric current type antenna and the magnetic current type antenna. As the result, it will be possible to vary the radiation directivity pattern.

In this embodiment, the diode is employed for the on-off operation of the capacity loading. However, a high frequency switch or a transistor may be employed to realize a similar function. Although the capacity to be loaded is fixed in this regulating circuit, it will be possible to load a desired amount of the capacity by employing in this part a variable capacitance diode which can vary a capacity value.

Moreover, parts on which the regulating circuits are to be mounted may be any place on the helical antenna elements 102, 103 including their tip ends to obtain similar effects.

As described, in the antenna unit, the antenna characteristic can be varied by regulating the regulating circuits, and the radiation directivity pattern can be switched according to the receiving environment.

As apparent from the foregoing description, the antenna unit according to the invention can reduce the electric current component flowing on the base plate of the radio set in which the antenna unit is incorporated, and can restrain a drop of the gain when the radio set is used in proximity to the human body. Moreover, the antenna unit can possess the antenna radiation characteristics of both the electric current type antenna and the magnetic current type antenna, and the receiving performance of the radio set when it is used in a tilted manner can be enhanced.

Further, the radiation pattern can be adjusted utilizing the base plate of the radio set, the influence of the human body can be decreased, and the high receiving performance of efficiently receiving the incoming waves can be realized.

In the antenna unit provided with the regulating circuits, the ratio between the components of the electric current type antenna and the magnetic current type antenna can be varied so that the radiation directivity pattern can be variable.

Still further, with the radio set incorporating this antenna unit, high grade and stable mobile communication has been made possible, and the compact and thin configuration of the radio set can be obtained.

What is claimed is:

1. An antenna unit adapted to be incorporated in a main body of a mobile radio set, comprising:

a pair of helical antenna elements connected to a balanced feeding line, the helical antenna elements having antenna axes in a direction parallel to a base plate of said radio set, and being arranged in proximity to said base plate of said radio set at a sufficiently small distance as compared with their wavelength, wherein said antenna unit performs both functions of a magnetic current type antenna and an electric current type antenna, and a regulating circuit which regulates a ratio between a component of said magnetic current type antenna and a component of said electric current type antenna.

2. An antenna unit according to claim 1, wherein the regulating circuit is connected to the helical antenna element.

3. An antenna unit according to claim 1, further comprising a balun connected to the helical antenna elements via the balanced feeding line to interconnect the balanced feeding line and an unbalanced feeding line.

4. An antenna unit according to claim 3, further comprising a radio circuit connected to the balun via the unbalanced feeding line.

5. An antenna unit according to claim 1, further comprising a radio circuit connected to the helical antenna elements via the balanced feeding line.

* * * * *

UNITED STATES PATENT AND TRADEMARK OFFICE

CERTIFICATE OF CORRECTION

PATENT NO. : 6,459,412 B1
DATED : October 1, 2002
INVENTOR(S) : Yoshio Koyanagi et al.

It is certified that error appears in the above-identified patent and that said Letters Patent is hereby corrected as shown below:

Column 3,
Line 40, after "." (period), please insert -- t --.
Line 64, please delete "E", and insert therefor -- θ --.

Column 5,
Line 16, after "." (period), please insert -- T --.

Signed and Sealed this

Eighteenth Day of February, 2003

JAMES E. ROGAN
*Director of the United States Patent and Trademark Office*